US012000603B2

(12) United States Patent
Zhou et al.

(10) Patent No.: US 12,000,603 B2
(45) Date of Patent: Jun. 4, 2024

(54) AUXILIARY MOUNTING DEVICE AND MOUNTING METHOD FOR SADDLE-TYPE WINDOW AIR CONDITIONER

(71) Applicants: QINGDAO HAIER AIR CONDITIONER GENERAL CORP., LTD., Shandong (CN); HAIER SMART HOME CO., LTD., Shandong (CN)

(72) Inventors: Shutao Zhou, Qingdao (CN); Wei Guo, Qingdao (CN); Long Zhang, Qingdao (CN); Guangbao Qiao, Qingdao (CN); Ruofeng Wang, Qingdao (CN); Tongkai Wang, Qingdao (CN); Yongcun Zhao, Qingdao (CN)

(73) Assignees: QINGDAO HAIER AIR CONDITIONER GENERAL CORP., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 426 days.

(21) Appl. No.: 17/607,665

(22) PCT Filed: Mar. 6, 2020

(86) PCT No.: PCT/CN2020/078273

§ 371 (c)(1),
(2) Date: Oct. 29, 2021

(87) PCT Pub. No.: WO2020/220828

PCT Pub. Date: Nov. 5, 2020

(65) Prior Publication Data

US 2022/0214053 A1 Jul. 7, 2022

(30) Foreign Application Priority Data

Apr. 29, 2019 (CN) ..... 201910353158.X

(51) Int. Cl.
*F24F 1/031* (2019.01)
*F24F 13/32* (2006.01)

(52) U.S. Cl.
CPC ..... *F24F 1/031* (2019.02); *F24F 13/32* (2013.01); *F24F 2221/20* (2013.01); *F24F 2221/36* (2013.01)

(58) Field of Classification Search
CPC .... F24F 1/031; F24F 1/027; F24F 1/03; F24F 13/32; F24F 2221/20; F24F 2221/36
See application file for complete search history.

(56) References Cited

U.S. PATENT DOCUMENTS 5,167,131 A * 12/1992 Karkhanis ..... F24F 1/027 62/262
6,389,834 B1 5/2002 LeClear et al.
(Continued)

FOREIGN PATENT DOCUMENTS

CN 101876465 A * 11/2010
CN 205747228 U 11/2016
(Continued)

OTHER PUBLICATIONS

International Search Report for PCT/CN2020/078273 (ISA/CN) dated May 26, 2020 with English translation (4 pages).
Written Opinion for PCT/CN2020/078273 (ISA/CN) dated May 26, 2020 with English translation (5 pages).

*Primary Examiner* — Joseph F Trpisovsky
(74) *Attorney, Agent, or Firm* — ALSTON & BIRD LLP

(57) ABSTRACT

An auxiliary mounting device and mounting method for a saddle-type window air conditioner. The auxiliary mounting device comprises a base and an airbag; the base is located on a window, an upper end of the airbag is connected to a connecting portion of the saddle-type window air conditioner, a lower end of the airbag is connected to the base), an air hole is provided on the airbag, and a plug is provided at
(Continued)

the air hole. When mounting the saddle-type window air conditioner, the airbag is inflated first, and then the saddle-type window air conditioner, together with the base and the airbag, is placed on the window, the base sits on the window, then the airbag is deflated, and the connecting portion gradually descends, along with the deflation of the airbag, in the direction towards the base, thereby enabling the saddle-type window air conditioner to fall slowly. The auxiliary mounting device has a simple structure and is easy to operate.

10 Claims, 3 Drawing Sheets

(56) References Cited

U.S. PATENT DOCUMENTS

| | | | | |
|---|---|---|---|---|
| 2003/0097854 | A1* | 5/2003 | Cur | F24F 1/027 62/262 |
| 2003/0110789 | A1 | 6/2003 | Cur et al. | |

FOREIGN PATENT DOCUMENTS

| | | | | |
|---|---|---|---|---|
| CN | 206469419 | U | 9/2017 | |
| CN | 109631718 | A | 4/2019 | |
| CN | 210399227 | U | 4/2020 | |
| WO | WO-2018133140 | A1 * | 7/2018 | F24F 1/027 |

* cited by examiner

AUXILIARY MOUNTING DEVICE AND MOUNTING METHOD FOR SADDLE-TYPE WINDOW AIR CONDITIONER

CROSS-REFERENCE TO RELATED APPLICATIONS

The present application is a national phase entry of International Application No. PCT/CN2020/078273, filed Mar. 6, 2020, which claims priority to Chinese Patent Application No. 201910353158.X, filed Apr. 29, 2019, which are incorporated herein by reference in their entirety.

FIELD OF THE INVENTION

The present invention relates to the technical field of window air conditioners, and in particular to an auxiliary mounting device and mounting method for a saddle-type window air conditioner.

BACKGROUND OF THE INVENTION

A saddle-type window air conditioner generally includes an indoor part, an outdoor part and a connecting part. The connecting part is used to connect the indoor part and the outdoor part. The outdoor part and the indoor part are located on the same side of the connecting part. The overall appearance of the window air conditioner is in an inverted U-shaped structure. After the saddle-type window air conditioner is mounted to the window, the connecting part is located on the window, and the indoor part and the outdoor part are both located below the window, which can prevent the window air conditioner from blocking the sun. The saddle-type window air conditioner is now favored by more and more consumers.

Due to the unique structure of the saddle-type window air conditioner, when the window air conditioner is moved to a window and descends on the window, the window air conditioner can easily fall suddenly, so that a large impact is generated between the connecting part and the window, thereby causing damage to the connecting part, and pipelines and components therein.

The above information disclosed in the background art is only used to enhance the understanding of the background art of the present application, and therefore, it may include the prior art that is not known to those of ordinary skill in the art.

BRIEF DESCRIPTION OF THE INVENTION

In view of the risk of sudden falling of a saddle-type window air conditioner in the mounting process in the prior art, the present invention provides an auxiliary mounting device for a saddle-type window air conditioner. The saddle-type window air conditioner can slowly fall in the mounting process through an airbag, and the auxiliary mounting device is simple in structure and convenient for operation.

In order to achieve the above objective, the present invention adopts the following technical solution:

The present invention provides an auxiliary mounting device for a saddle-type window air conditioner. The saddle-type window air conditioner includes: an indoor part, located on an indoor side; an outdoor part, located on an outdoor side; a connecting part, located on a window, where one end is connected to the indoor part, and the other end is connected to the outdoor part. The auxiliary mounting device includes: a base, located on the window; and an airbag, located below the connecting part, wherein an upper end of the airbag is connected to the connecting part, a lower end of the airbag is connected to the base, the airbag is provided with an air hole, and the air hole is provided with a plug. The connecting part gradually moves in a direction towards the base along with deflation of the airbag.

In order to prevent the airbag from being exposed to the outside for a long time to accelerate the aging and affect the beautiful appearance, the base includes a bottom plate and side plates disposed around the bottom plate and extending toward the airbag side. When the airbag is in a compressed state, the side plates abut against the connecting part, and the airbag is located between the bottom plate and the connecting part.

In order to facilitate mounting and demounting, the upper end of the airbag is provided with an upper connecting portion. The upper connecting portion is bonded or detachably connected to the connecting part. The lower end of the airbag is provided with a lower connecting portion. The lower connecting portion is bonded or detachably connected to the base.

In order to make the descending process of the saddle-type window air conditioner more stable and reliable, a plurality of airbags are provided and are symmetrically arranged between the base and the connecting part.

In order to make the airbag match saddle-type window air conditioners of different weights such that the saddle-type window air conditioners cannot fall too fast or too slowly, the airbag is provided with two air holes with different diameters.

In order to ensure that a curtain component can be well sealed with a side wall of the connecting part and a side wall of the base at the same time, a width of the base is set equal to a width of the connecting part.

In order to avoid movement interference of the base during the falling process of the indoor part and the outdoor part of the saddle-type window air conditioner, a length of the base is set not greater than a smallest length of the connecting part.

In order to avoid movement interference between the indoor part or outdoor part and the window in the falling process of the saddle-type window air conditioner, when the airbag is in an inflated state, a lower surface of the base is retracted into a lower surface of the indoor part and a lower surface of the outdoor part.

The present invention further provides a mounting method for a saddle-type window air conditioner by using the auxiliary mounting device for the saddle-type window air conditioner as described above. The mounting method includes the following steps: connecting the upper end of the airbag to the connecting part, and connecting the lower end of the airbag to the base; inflating the airbag through the air hole, and inserting the plug into the air hole after the airbag is fully inflated; moving the saddle-type window air conditioner together with the base and the fully inflated airbag onto a window, and placing the base on the window such that the indoor part is located on the indoor side and the outdoor part is located on the outdoor side; and removing the plug such that the connecting part gradually moves in a direction towards the base along with deflation of the airbag.

Further, the mounting method further includes the following step: separating the upper end of the airbag from the connecting part, and withdrawing the base and the airbag from below the connecting part.

Compared with the prior art, the present invention has the following advantages and positive effects:

The present invention provides the auxiliary mounting device and mounting method for the saddle-type window air conditioner. The auxiliary mounting device includes the base and the airbag, the base is located on the window, the upper end of the airbag is connected to the connecting part of the saddle-type window air conditioner, the lower end of the airbag is connected to the base, the airbag is provided with the air hole, and the air hole is provided with the plug. During mounting of the saddle-type window air conditioner, first, the airbag is inflated, the saddle-type window air conditioner together with the base and the airbag is placed on the window, and the base is located on the window. Then, the airbag is deflated, and the connecting part gradually descends in the direction towards the base along with the deflation of the airbag, so that the saddle-type window air conditioner slowly falls. The auxiliary mounting device is simple in structure and convenient for operation.

After reading the detailed description of the present invention in conjunction with the accompanying drawings, other characteristics and advantages of the present invention will become clearer.

BRIEF DESCRIPTION OF THE DRAWINGS

To describe the technical solutions in the embodiments of the present invention or in the prior art clearly, the following briefly describes the accompanying drawings required for describing the embodiments or the prior art. Apparently, the accompanying drawings in the following description show some embodiments of the present invention, and persons of ordinary skill in the art may still derive other drawings from these accompanying drawings without creative efforts.

In the figures, 10—auxiliary mounting device, 11—airbag, 111—air hole, 12—base, 121—bottom plate, 122—side plate, 13—plug, 20—saddle—type window air conditioner, 21—indoor part, 22—connecting part, 23—outdoor part;

W—width of connecting part, L—length of connecting part.

DETAILED DESCRIPTION

In order to make objects, technical solutions and advantages of embodiments of the present invention clearer, the technical solutions in the embodiments of the present invention are clearly and completely described below in conjunction with the accompanying drawings in the embodiments of the present invention, and it is apparent that the described embodiments are parts of embodiments rather than all embodiments of the present invention. All other embodiments obtained by a person of ordinary skill in the art based on the embodiments of the present invention without creative efforts shall fall within the protection scope of the present invention.

It should be noted that in the description of the present invention, the terms "upper", "lower", "left", "right", "vertical", "horizontal", "inner", "outer" and other terms indicating the direction or positional relationship are based on the direction or positional relationship shown in the accompanying drawings. This is only for the convenience of description, and does not indicate or imply that the device or element must have a specific orientation, or be constructed and operated in a specific orientation, and therefore cannot be understood as a limitation of the present invention. In addition, the terms "first" and "second" are only used for descriptive purposes, and cannot be understood as indicating or implying relative importance.

Figure 1:
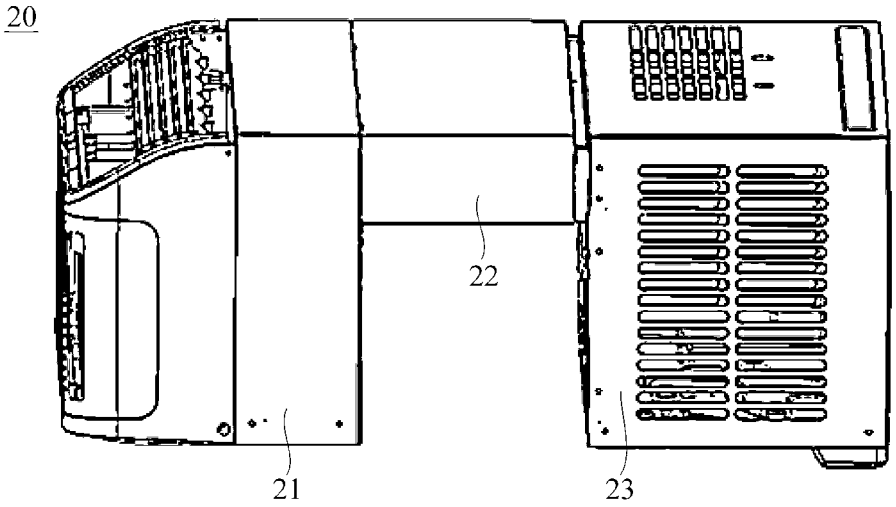
FIG. 1 is a schematic structural diagram of an embodiment of a saddle-type window air conditioner according to the present invention.

The present invention discloses an auxiliary mounting device for a saddle-type window air conditioner, applied to a mounting process of a saddle-type window air conditioner. With reference to FIG. 1, the saddle-type window air conditioner 20 includes an indoor part 21, an outdoor part 23 and a connecting part 22. The indoor part 21 is located on an indoor side, and located below a window. The outdoor part 23 is located on an outdoor side, and located below the window. The connecting part 22 is configured to connect the indoor part 21 and the outdoor part 23, and the overall appearance of the window air conditioner is in an inverted U-shaped structure. The connecting part 22 is available in two forms: retractable and non-retractable. When the retractable mode is used, the connecting part 22 has an adjustable length to adapt to windows of different sizes. After the saddle-type window air conditioner 20 is mounted to the window, the connecting part 22 is located on the window, and the indoor part 21 and the outdoor part 23 are both located below the window, which can prevent the window air conditioner from blocking the sun.

The auxiliary mounting device 10 includes a base 12 and an airbag 11. The base 12 is located on the window, the airbag 11 is located below the connecting part 22, an upper end of the airbag 11 is connected to the connecting part 22, and a lower end of the airbag 11 is connected to the base 12. The airbag 11 is provided with an air hole 111, and a plug 13 is inserted into the air hole 111.

During mounting, first, the saddle-type window air conditioner 20 is placed on the ground. The upper end of the airbag 11 is connected to a lower surface of the connecting part 22. The lower end of the airbag 11 is connected to an upper surface of the base 12. At this time, the airbag 11 is suspended below the connecting part 22 under the action of the gravity of the base 12.

Figure 2:
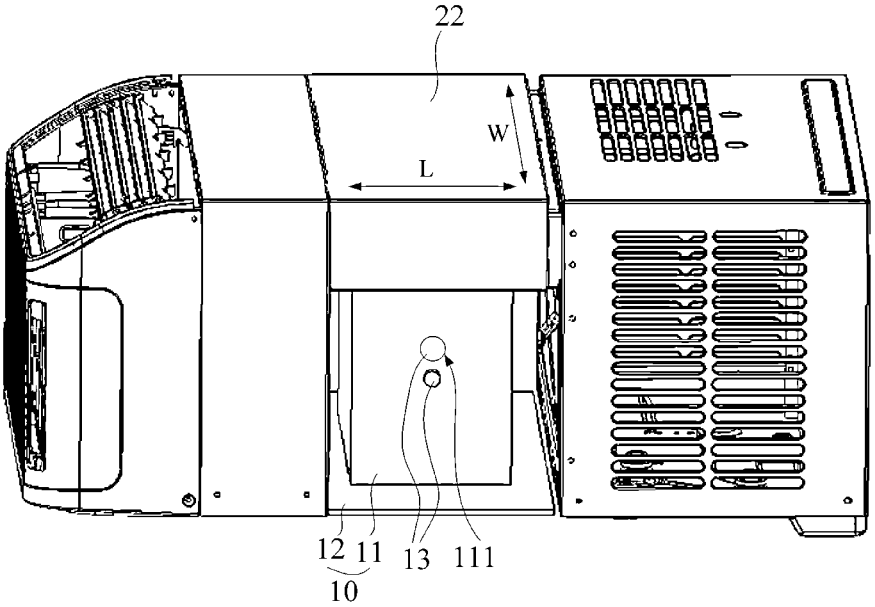
FIG. 2 is a schematic structural diagram of an embodiment after an auxiliary mounting device is inflated according to the present invention.

The airbag 11 is inflated through the air hole 111 by using an inflating tool such as an air pump or the like. After the airbag is fully inflated, the plug 13 is inserted into the air hole 111. For the schematic structural diagram of the auxiliary mounting device 10 after full inflation, reference may be made to FIG. 2, and at this time, the airbag 11 fills the suspended part below the connecting part 22.

The saddle-type window air conditioner 10 together with the base 12 and the fully inflated airbag 11 is moved onto a window, and the base 12 is placed on the window such that the indoor part 21 is located on the indoor side and the outdoor part 23 is located on the outdoor side.

Figure 3:
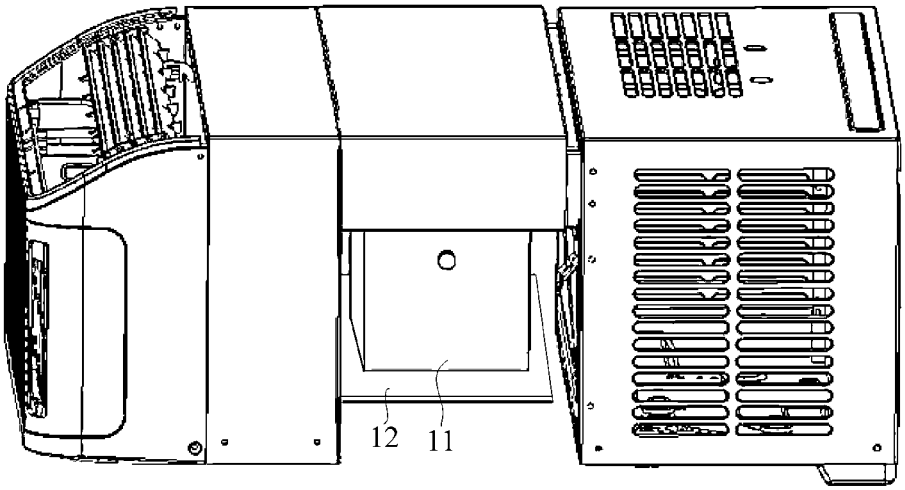
FIG. 3 is a schematic structural diagram of an embodiment in a deflation process of the auxiliary mounting device according to the present invention.

The plug 13 is removed, the airbag 11 starts to be deflated gradually, and the connecting part 22 gradually moves in a direction towards the base 12 along with the deflation of the airbag 11, that is, the complete saddle-type window air conditioner 20 gradually and slowly falls along with the deflation of the airbag 11. For the schematic structural diagram in the deflation process of the airbag 11, reference may be made to FIG. 3.

Figure 4:
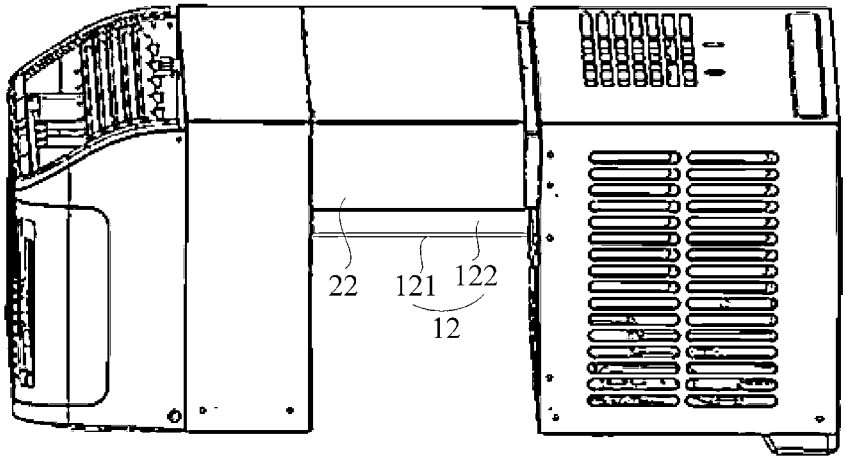
FIG. 4 is a schematic structural diagram of an embodiment after the auxiliary mounting device is deflated and compressed according to the present invention.

After the airbag 11 finishes deflation and is compressed, the connecting part 22 is located above the base 12, and at this time, the indoor part 21 and the outdoor part 23 are respectively located below the window. For the schematic structural diagram of the airbag 11 after being deflated and compressed, reference may be made to FIG. 4.

If the connecting part 22 uses a retractable mode, the indoor part 21 or the outdoor part 23 is pushed to adjust the length of the connecting part, so that the complete air conditioner adapts to the corresponding window size. Thus, the mounting of the saddle-type window air conditioner 20 is completed.

In this embodiment, there is one airbag 11 used. In other embodiments, there may be a plurality of airbags 11 disposed, but they need to be symmetrically arranged between the base 12 and the connecting part 22. When a plurality of airbags 11 are deflated at the same time, the complete air conditioner can fall more stably, and cannot easily tilt in the falling process. For example, two airbags 11 are disposed between the base 12 and the connecting part 22. One airbag 11 is close to the indoor part 21 side, and the other airbag 11 is close to the outdoor part 23 side. At the time of deflation, the plugs 13 on the two airbags 11 need to be removed at the same time to enable the two airbags 11 to be deflated synchronously, so that the complete air conditioner can fall stably.

When the form of a plurality of airbags 11 is used, if a certain airbag 11 thereof is damaged, the other airbags 11 may also continue to drive the complete air conditioner to slowly fall, so that the mounting process proceeds smoothly, thereby ensuring the mounting progress.

The airbag 11 is provided with two air holes 111 with different diameters. At the time of deflation, the air hole 111 with a suitable diameter may be selected for deflation according to the weight of the complete air conditioner, such that the complete air conditioner falls more stably, thereby preventing the complete air conditioner from falling too fast or too slowly.

The upper end of the airbag 11 is provided with an upper connecting portion (not shown), and the upper connecting portion is bonded or detachably connected to the lower surface of the connecting part 22. The lower end of the airbag 11 is provided with a lower connecting portion (not shown), and the lower connecting portion is bonded or detachably connected to the upper surface of the base 12. Specifically, when the detachable connection mode is used, common fastening manners such as hooks, buckles and the like may be selected. For example, the upper connecting portion and the lower connecting portion are respectively provided with hooks, the lower surface of the connecting part and the upper surface of the base are respectively correspondingly provided with suspension loops, and the hook is hooked to the suspension loop, which is convenient for mounting and demounting.

After the window air conditioner is mounted, a curtain component (not shown) is disposed between the window air conditioner and a window frame. The curtain component serves to close the window air conditioner and the window frame, thereby avoiding heat exchange between indoor and outdoor environments. After using the auxiliary mounting device of this embodiment, a width of the base 12 is set equal to a width of the connecting part 22, and the width of the connecting part 22 is marked as W, with reference to FIG. 2. In this way, after the airbag 11 is deflated and compressed, the curtain component can well realize sealing with a side wall of the connecting part 22 and a side wall of the base 12 at the same time without making special structural changes to the curtain component.

When the connecting part 22 uses the non-retractable form, a length of the base 12 is not greater than a length of the connecting part 22. When the connecting part 22 adopts the retractable form, a length of the base 12 is not greater than a smallest length of the connecting part 22, and the length of the connecting part 22 is marked as L, with reference to FIG. 2. In this way, movement interference of the base 12 during the falling process of the saddle-type window air conditioner 20 can be avoided.

When the airbag 11 is in the inflated state, the lower surface of the base 12 is retracted into the lower surface of the indoor part 21 and the lower surface of the outdoor part 23. Thus, the base 12, the indoor part 21 and the outdoor part 23 form an inverted U-shaped structure with a smaller height. When the saddle-type window air conditioner 20 together with the base 12 and the inflated airbag 11 is placed onto the window, the inverted U-shaped structure with a smaller height performs functions of locating and clamping to some extent, that is, the saddle-type window air conditioner 20 is preliminarily located and clamped onto the window. Therefore, after the airbag 11 is deflated, the indoor part 21 after falling can be located on the indoor side without generating movement interference with the window, and the outdoor part 23 can be located on the outdoor side without generating movement interference with the window.

In this embodiment, the auxiliary mounting device 10 and the saddle-type window air conditioner 20 may be in two forms: a fixed form or a detachable form.

When the fixed form is used, after the saddle-type window air conditioner 20 is mounted onto the window and the airbag 11 is deflated, the airbag 11 and the base 12 are located between the connecting part 22 and the window frame all the time. In order to prevent the airbag 11 from being exposed to the outside for a long time to accelerate the aging and affect the beautiful appearance, the base 12 is structurally improved in this embodiment. Specifically, with reference to FIG. 4, the base 12 includes a bottom plate 121 and side plates 122 disposed around the bottom plate 121 and extending toward the airbag 11 side. When the airbag 11 is in a deflated and compressed state, the side plates 122 abut against the connecting part 22, the bottom plate 121, the side plates 122 and the connecting part 22 form a hollow cavity, and the airbag 11 is located in the hollow cavity, thereby preventing the airbag from being exposed to the outside. At the same time, the side plates 122 abut against the connecting part 22, which can also prevent the connecting part 22 from directly exerting gravity on the airbag 11 and prevent the airbag 11 from damage due to pressing.

The side plates 122 and the side wall of the connecting part 22 are on the same vertical surface. After the saddle-type window air conditioner 20 is mounted in place, the curtain component can well realize sealing with the side plates 122 and the side wall of the connecting part 22 at the same time, thereby enhancing the sealing effect.

When the saddle-type window air conditioner 20 needs to be removed from the window, in order to facilitate demounting, one of the side plates 122 may be set in an openable form, so that the air hole 111 in the airbag 11 can be exposed. The airbag 11 is inflated through the air hole 111 by using an inflating tool such as an air pump or the like. As the airbag 11 continues to be inflated, the connecting part 22 is gradually lifted up by the airbag 11, and the complete saddle-type window air conditioner 20 also gradually rises. After the inflation of the airbag 11 is completed, the air hole 111 is blocked with the plug 13. At this time, the lower surfaces of the indoor part 21 and the outdoor part 23 are already very close to the window, and it will save a lot of effort to move the complete saddle-type window air conditioner 20 off from the window.

Figure 5:
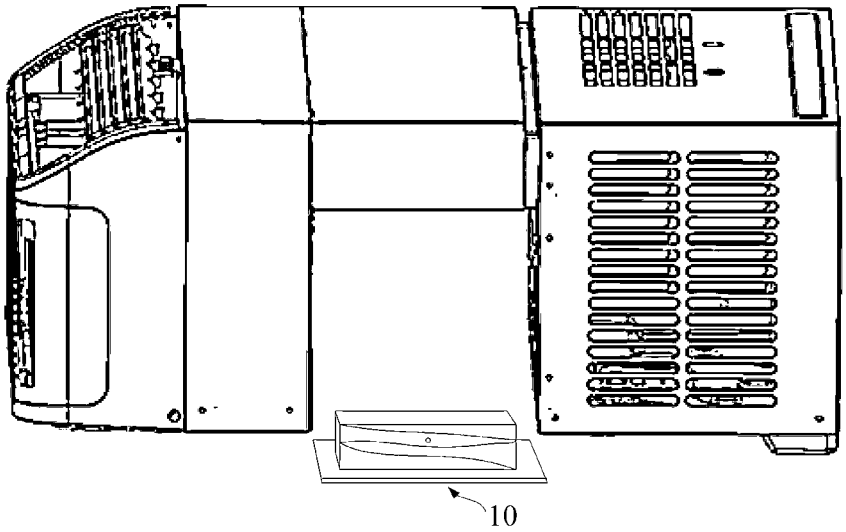
FIG. 5 is a schematic structural diagram of another embodiment after the auxiliary mounting device is deflated and compressed according to the present invention.

When the detachable form is used, the upper end of the airbag 11 and the lower surface of the connecting part 22 need to be connected in a detachable manner After the airbag 11 is deflated and compressed and the saddle-type window air conditioner 20 is mounted in place, the connection relation between the upper end of the airbag 11 and the lower surface of the connecting part 22 is dissolved. For example, the hook is removed from the suspension loop, the upper end of the airbag 11 is separated from the lower surface of the connecting part 22, and then, the base 12 and the airbag 11 are together withdrawn from below the connecting part 22, with reference to FIG. 5.

It should be illustrated finally that, the above embodiments are only used for illustrating the technical solutions of the present invention, and are not intended to limit the present invention; although the present invention is illustrated in detail with reference to the foregoing embodiments, it should be understood by those skilled in the art that, modifications may still be made on the technical solutions written by the foregoing embodiments, or equivalent replacements are made on part of technical features; and these modifications or replacements do not make the essence of the corresponding technical solutions depart from the spirit and scope of the technical solution of the various embodiments of the present invention.

The invention claimed is:

1. An auxiliary mounting device for a saddle-type window air conditioner, wherein the saddle-type window air conditioner comprises:

an indoor part, located on an indoor side;

an outdoor part, located on an outdoor side;

a connecting part, located on a window, wherein one end is connected to the indoor part, and the other end is connected to the outdoor part; wherein the auxiliary mounting device comprises:

a base, located on the window; and an airbag, located below the connecting part, wherein an upper end of the airbag is connected to the connecting part, a lower end of the airbag is connected to the base, the airbag is provided with an air hole, and the air hole is provided with a plug; and the connecting part gradually moves in a direction towards the base along with deflation of the airbag.

2. The auxiliary mounting device for the saddle-type window air conditioner according to claim 1, wherein the base comprises a bottom plate and side plates disposed around the bottom plate and extending toward the airbag side, and when the airbag is in a compressed state, the side plates abut against the connecting part, and the airbag is located between the bottom plate and the connecting part.

3. The auxiliary mounting device for the saddle-type window air conditioner according to claim 1, wherein the upper end of the airbag is provided with an upper connecting portion, and the upper connecting portion is bonded or detachably connected to the connecting part; and the lower end of the airbag is provided with a lower connecting portion, and the lower connecting portion is bonded or detachably connected to the base.

4. The auxiliary mounting device for the saddle-type window air conditioner according to claim 1, wherein a plurality of airbags are provided and symmetrically arranged between the base and the connecting part.

5. The auxiliary mounting device for the saddle-type window air conditioner according to claim 1, wherein the airbag is provided with two air holes with different diameters.

6. The auxiliary mounting device for the saddle-type window air conditioner according to claim 1, wherein a width of the base is equal to a width of the connecting part.

7. The auxiliary mounting device for the saddle-type window air conditioner according to claim 1, wherein a length of the base is not greater than a smallest length of the connecting part.

8. The auxiliary mounting device for the saddle-type window air conditioner according to claim 1, wherein when the airbag is in an inflated state, a lower surface of the base is retracted into a lower surface of the indoor part and a lower surface of the outdoor part.

9. A mounting method for a saddle-type window air conditioner by using the auxiliary mounting device for the saddle-type window air conditioner according to claim 1, comprising the following steps:

connecting the upper end of the airbag to the connecting part, and connecting the lower end of the airbag to the base;

inflating the airbag through the air hole, and inserting the plug into the air hole after the airbag is fully inflated;

moving the saddle-type window air conditioner together with the base and the fully inflated airbag onto a window, and placing the base on the window such that the indoor part is located on the indoor side and the outdoor part is located on the outdoor side; and removing the plug such that the connecting part gradually moves in a direction towards the base along with deflation of the airbag.

10. The mounting method for the saddle-type window air conditioner according to claim 9, further comprising the following step:

separating the upper end of the airbag from the connecting part, and withdrawing the base and the airbag from below the connecting part.

* * * * *